US008479454B2

(12) United States Patent
Lenney et al.

(10) Patent No.: US 8,479,454 B2
(45) **Date of Patent: *Jul. 9, 2013**

(54) SUPPORTED MESH DEBRIS PRECLUSION SYSTEM FOR GUTTERS

(75) Inventors: Robert C. Lenney, Newcastle, CA (US); John R. Lewis, Modesto, CA (US)

(73) Assignee: Gutterglove, Inc., Rocklin, CA (US)

( * ) Notice: Subject to any disclaimer, the term of this patent is extended or adjusted under 35 U.S.C. 154(b) by 130 days.

This patent is subject to a terminal disclaimer.

(21) Appl. No.: 12/924,326

(22) Filed: Sep. 23, 2010

(65) Prior Publication Data

US 2011/0067318 A1 Mar. 24, 2011

Related U.S. Application Data

(60) Provisional application No. 61/277,406, filed on Sep. 23, 2009.

(51) Int. Cl.
*E04D 13/04* (2006.01)
*E04D 13/064* (2006.01)

(52) U.S. Cl.
USPC ..... 52/12; 52/11; 248/48.1

(58) Field of Classification Search
USPC ..... 52/12, 15, 11, 741.3, 745.06; 248/48.1, 248/48.2; 210/474
See application file for complete search history.

(56) References Cited

U.S. PATENT DOCUMENTS

| | | | | |
|---|---|---|---|---|
| 1,732,058 | A | | 10/1929 | Martini |
| 2,229,381 | A | | 1/1941 | Grow |
| 2,288,121 | A | | 6/1942 | Sandmeyer |
| 2,583,422 | A | | 1/1952 | Haddon |
| 3,426,909 | A | * | 2/1969 | Garner ..... 210/474 |
| 3,691,343 | A | | 9/1972 | Norman |
| 4,308,696 | A | | 1/1982 | Schroeder |
| 4,435,466 | A | | 3/1984 | Kuhnel et al. |
| 4,646,488 | A | | 3/1987 | Burns |
| 4,745,710 | A | | 5/1988 | Davis |
| 4,755,229 | A | | 7/1988 | Armanini |
| 4,769,526 | A | | 9/1988 | Taouil |
| 4,827,686 | A | | 5/1989 | Stamper et al. |
| 4,949,514 | A | | 8/1990 | Weller |

(Continued)

FOREIGN PATENT DOCUMENTS

| | | |
|---|---|---|
| JP | 06-146506 | 5/1994 |
| JP | 09228592 | 9/1997 |

(Continued)

*Primary Examiner* — Phi A
(74) *Attorney, Agent, or Firm* — Glen L. Gross, Esq.; Shlesinger, Arkwright & Garvey, LLP

(57) ABSTRACT

Multiple assemblies are provided to overlie a gutter to preclude debris entry. Each assembly includes a mesh positioned upon an underlying substantially rigid support. The support has a tab which can reside beneath shingles and over other portions of the roof. A front edge is provided opposite the tab which rests upon a lip of the gutter when installed. A floor is located between the front edge and tab at a position slightly below a plane in which the tab and front edge are located. The mesh overlies the floor. Holes in the floor allow water which passes down through the mesh to be conducted through the floor and to fall down into the gutter. Ribs extend up from the floor to support the mesh and draw water off of the mesh. The mesh is corrugated into a plurality of crests and troughs which extend perpendicular to the ribs.

17 Claims, 3 Drawing Sheets

U.S. PATENT DOCUMENTS

| | | | | |
|---|---|---|---|---|
| 5,010,696 | A | 4/1991 | Knittel | |
| 5,044,581 | A * | 9/1991 | Dressler | 248/48.1 |
| 5,107,635 | A | 4/1992 | Carpenter | |
| 5,127,200 | A | 7/1992 | Doran | |
| 5,261,195 | A | 11/1993 | Buckenmaier | |
| 5,315,090 | A | 5/1994 | Lowenthal | |
| 5,391,858 | A | 2/1995 | Tourangeau | |
| 5,398,464 | A | 3/1995 | Jacobs | |
| 5,406,754 | A | 4/1995 | Cosby | |
| 5,558,705 | A | 9/1996 | Keemer et al. | |
| 5,617,678 | A * | 4/1997 | Morandin et al. | 52/11 |
| 5,640,809 | A | 6/1997 | Iannelli | |
| 5,729,931 | A | 3/1998 | Wade | |
| 5,759,255 | A | 6/1998 | Venturini et al. | |
| 5,878,533 | A | 3/1999 | Swanfeld | |
| 6,134,843 | A | 10/2000 | Tregear | |
| 6,194,049 | B1 | 2/2001 | Bindschedler-Galli et al. | |
| 6,194,519 | B1 | 2/2001 | Blalock et al. | |
| 6,205,715 | B1 | 3/2001 | Rex | |
| 6,225,600 | B1 | 5/2001 | Burris | |
| 6,341,462 | B2 | 1/2002 | Kiilk et al. | |
| 6,598,352 | B2 * | 7/2003 | Higginbotham | 52/12 |
| 6,607,781 | B2 | 8/2003 | Joedicke et al. | |
| 6,700,098 | B1 | 3/2004 | Wyatt et al. | |
| 6,708,452 | B1 | 3/2004 | Tenute | |
| 6,759,630 | B1 | 7/2004 | Tenute | |
| 6,933,007 | B2 | 8/2005 | Fensel et al. | |
| 6,942,419 | B2 | 9/2005 | Knak | |
| 6,944,992 | B2 * | 9/2005 | Brochu | 52/12 |
| 6,951,077 | B1 | 10/2005 | Higginbotham | |
| 6,959,512 | B2 | 11/2005 | Cobb | |
| 7,104,012 | B1 | 9/2006 | Bayram | |
| 7,174,688 | B2 | 2/2007 | Higginbotham | |
| 7,191,564 | B2 | 3/2007 | Higginbotham | |
| 7,241,500 | B2 | 7/2007 | Shiao et al. | |
| 7,310,912 | B2 * | 12/2007 | Lenney et al. | 52/12 |
| 7,448,167 | B2 | 11/2008 | Bachman | |
| 7,624,541 | B2 * | 12/2009 | Gentry | 52/12 |
| 7,726,076 | B2 * | 6/2010 | Staub | 52/11 |
| 7,793,465 | B2 * | 9/2010 | McCann | 52/12 |
| 7,913,458 | B2 | 3/2011 | Higginbotham | |
| 7,975,435 | B2 | 7/2011 | Lenney | |
| 8,006,438 | B2 * | 8/2011 | Higginbotham | 52/12 |
| 8,033,058 | B2 | 10/2011 | Block | |
| RE42,896 | E * | 11/2011 | Higginbotham | 52/12 |
| 8,079,183 | B2 * | 12/2011 | Lenney | 52/12 |
| 2003/0046876 | A1 | 3/2003 | Higginbotham | |
| 2003/0198736 | A1 | 10/2003 | Fensel et al. | |
| 2005/0072114 | A1 | 4/2005 | Shiao et al. | |
| 2005/0279036 | A1 | 12/2005 | Brochu | |
| 2006/0037252 | A1 | 2/2006 | Gosse et al. | |
| 2006/0117670 | A1 | 6/2006 | Tsioris | |
| 2006/0179723 | A1 * | 8/2006 | Robins | 52/11 |
| 2006/0196124 | A1 | 9/2006 | Bachman | |
| 2006/0213129 | A1 | 9/2006 | Bachman | |
| 2006/0277831 | A1 | 12/2006 | Bachman | |
| 2006/0283096 | A1 | 12/2006 | Bachman | |
| 2006/0283097 | A1 * | 12/2006 | Gregg | 52/12 |
| 2007/0054129 | A1 | 3/2007 | Kalkanoglu et al. | |
| 2007/0065640 | A1 | 3/2007 | Joedicke | |
| 2007/0094939 | A1 | 5/2007 | Bachman | |
| 2007/0107323 | A1 | 5/2007 | Higginbotham | |
| 2007/0199276 | A1 | 8/2007 | Duque | |
| 2007/0218251 | A1 | 9/2007 | Jacobs | |
| 2007/0234647 | A1 | 10/2007 | Higginbotham | |
| 2007/0246449 | A1 | 10/2007 | Bachman | |
| 2008/0187708 | A1 | 8/2008 | Decker | |
| 2008/0248241 | A1 | 10/2008 | Kalkanoglu et al. | |
| 2009/0056234 | A1 | 3/2009 | Brochu | |
| 2009/0064628 | A1 | 3/2009 | Mellott et al. | |
| 2011/0253611 | A1 | 10/2011 | Higginbotham | |
| 2012/0042579 | A1 | 2/2012 | Mccoy | |

FOREIGN PATENT DOCUMENTS

| | | |
|---|---|---|
| JP | 2000-008559 | 1/2000 |
| KR | 1989-10803 | 7/1989 |
| KR | 1989-23083 | 12/1989 |
| KR | 1998-16228 | 6/1998 |

* cited by examiner

SUPPORTED MESH DEBRIS PRECLUSION SYSTEM FOR GUTTERS

CROSS-REFERENCE TO RELATED APPLICATIONS

This application claims benefit under Title 35, United States Code §119(e) of U.S. Provisional Application No. 61/277,406 filed on Sep. 23, 2009.

FIELD OF THE INVENTION

The following invention relates to rain gutter debris preclusion systems, often referred to as gutter guards, which are placed over gutters. More particularly, this invention relates to rain gutter debris preclusion systems which include a screen or filter element supported above a rigid structural support element for filtration of debris out of water before passing into the gutter.

BACKGROUND OF THE INVENTION

Gutters are commonly used along eaves at a lower end of a sloping roof to catch water running off of the roof and channel that water into particular areas rather than allowing the water to merely fall from the lower edges of the roof. Such gutters often become clogged, especially when trees are located nearby and shed leaves which can end up in the gutters. Accordingly, leaf preclusion systems, often called "gutter guards," are known in the prior art for attachment over the gutters. Such gutter guards serve the basic purpose of allowing water to pass into the gutter but precluding leaves and other debris from passing into the gutter.

One type of gutter guard utilizes a filter layer which has small openings therein which allow water to pass through but which preclude leaves and other debris from passing therethrough. One example of such a prior art mesh based leaf preclusion system is in U.S. Pat. No. 7,310,912, incorporated herein by reference.

The phenomena of water tension and molecular adhesion forces tend to cause water to not want to pass through such mesh layers, but rather to cling to the mesh. These forces thus frustrate the ability of mesh based gutter guards to allow water to pass through the mesh while precluding debris from passing into the gutter. With known prior art mesh based gutter guards, commonly an underlying support is provided beneath the mesh. This underlying support serves two purposes. First, it keeps the mesh generally planar overlying the gutter. Second, it contacts an underside of the mesh providing a path along which water can flow while adhering to the underlying support. Holes in the underlying support then allow water to drop through in larger drops where the weight of the drops is sufficient that the surface tension and adhesion forces cannot resist such dropping.

SUMMARY OF THE INVENTION

With this invention a filter mesh based two part gutter guard is provided including a substantially rigid support and a mesh overlying the support. The mesh functions to filter leaves and other debris so that they cannot fall into the gutter while the support keeps the mesh approximately planar covering the gutter. The support includes a tab at one end that can fit beneath shingles and typically upon a moisture barrier beneath shingles on the roof. A front edge is provided opposite the tab which can rest upon a front lip of a gutter and potentially be attached to the front lip of the gutter.

The support includes a recessed area between the tab and the lip. This recessed area includes a floor with ribs extending up from the floor and with holes passing through the floor. The ribs extend up to a line parallel with planes of the lip and tab to support the mesh in a generally planar configuration parallel with the tab and lip.

The mesh can be entrained within slots with one lower slot adjacent the lip and one upper slot adjacent the tab. These slots can also be configured with an adhesive or other bonding agent or can be crimped down onto the mesh to hold the mesh in place.

Water coming off of the roof is assisted by the tab to travel down and laterally onto the mesh. Debris remains on top of the mesh while water passes through the mesh. The ribs help to channel the water off a lower side of the mesh down to the floor. The water can then pass through holes in the floor to fall down into the gutter. The holes are large enough that adhesion forces are overcome and water can freely drop down through the holes. The holes are small enough, however, and in such a pattern that material remains to give strength to the overall support, so that the support can withstand loads, such as snow loads or heavy debris loads.

To add additional strength to the mesh, to minimize the requirement for ribs, and concentrate water more effectively, the mesh can have some form of corrugated cross-section, so that the mesh is partially self-supported and partially supported by the ribs.

The corrugations run in a direction from the tab to the lip and perpendicular to a longest dimension of each segment of the underlying support. Coupler fingers are provided between adjacent segments of supports and meshes. These connectors hold the separate segments together.

OBJECTS OF THE INVENTION

Accordingly, a primary object of the present invention is to provide a system for keeping debris out of gutters.

Another object of the present invention is to provide a gutter debris preclusion system which is of simple but effective construction.

Another object of the present invention is to provide a method for allowing water to pass through the gutter while keeping debris out of the gutter.

Another object of the present invention is to provide a gutter guard which can be customized to fit different gutter configurations and roof geometries.

Another object of the present invention is to provide a gutter guard which concentrates the water coming onto the screen thereof into troughs for most effective conduction of the water through the screen and on down into the gutter with a minimum of required surface area.

Another object of the present invention is to provide a gutter guard with a screen portion and an underlying support, and which has resistance to collapse built into both the screen and the mesh.

Other further objects of the present invention will become apparent from a careful reading of the included drawing figures, the claims and detailed description of the invention.

DESCRIPTION OF THE PREFERRED EMBODIMENT

Figure 1:
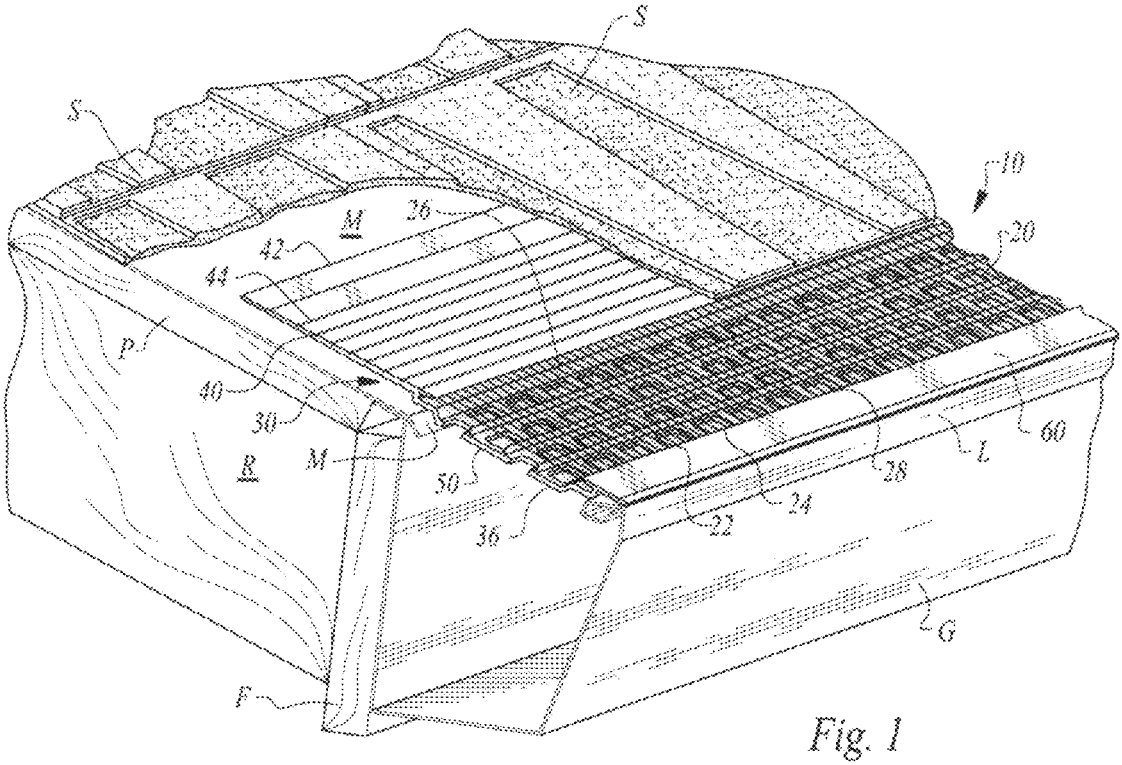
FIG. 1 is a perspective view of the debris preclusion system of this invention installed upon a gutter adjacent an eave of a roof and with portions of shingles cut away to reveal particular placement of the system upon the roof and over the gutter.

Referring to the drawings, wherein like reference numerals represent like parts throughout the various drawing figures, reference numeral 10 is directed to a debris preclusion assembly (FIGS. 1 and 2) which can be placed overlying a gutter G adjacent a facia F of a roof R and with portions of the assembly 10 underlying shingles S. The assembly 10 includes an underlying support 30 with a mesh 20 on top of the support 30. Water going off of the shingles S is thus directed onto the mesh 20 (along arrow B of FIG. 2) and then conducted down through the mesh 20 and through holes 56 (FIGS. 3 and 4) in the support 30 before traveling (along arrow A of FIG. 2) underneath the support 30 and then dropping (along arrow E of FIG. 2) as a drop D into the gutter G.

Figure 2:
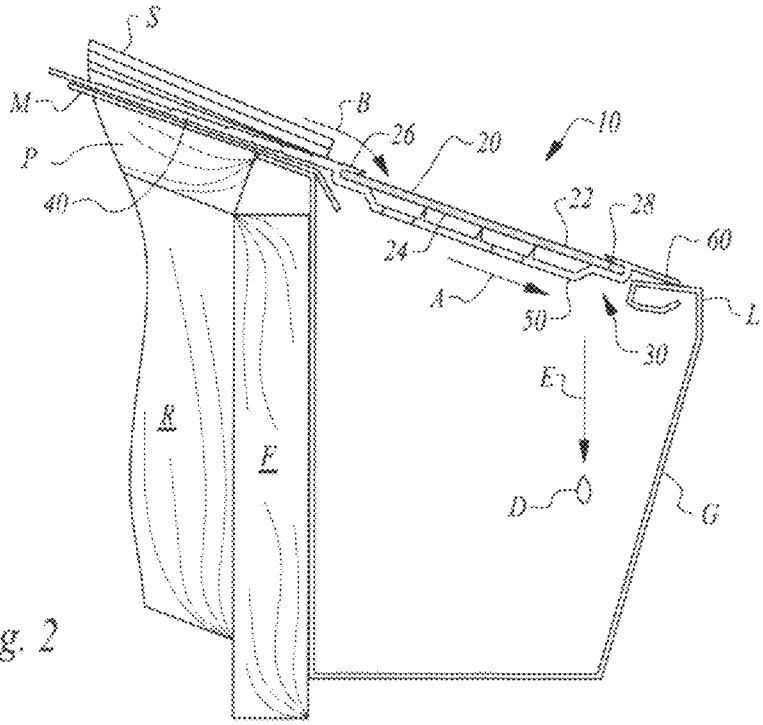
FIG. 2 is a side elevation view of that which is shown in FIG. 1.
Figure 3:
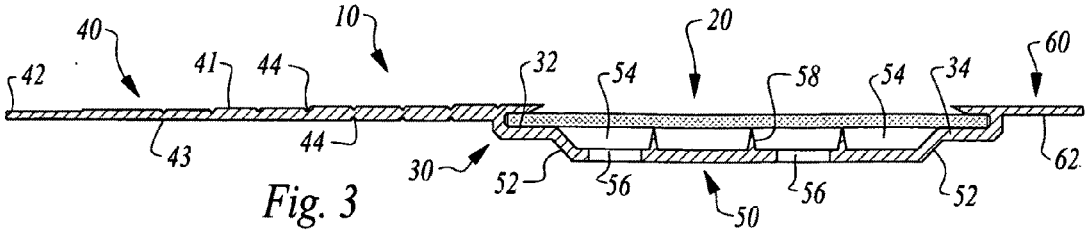
FIG. 3 is a side elevation view of the debris preclusion assembly alone and off of the roof.
Figure 4:
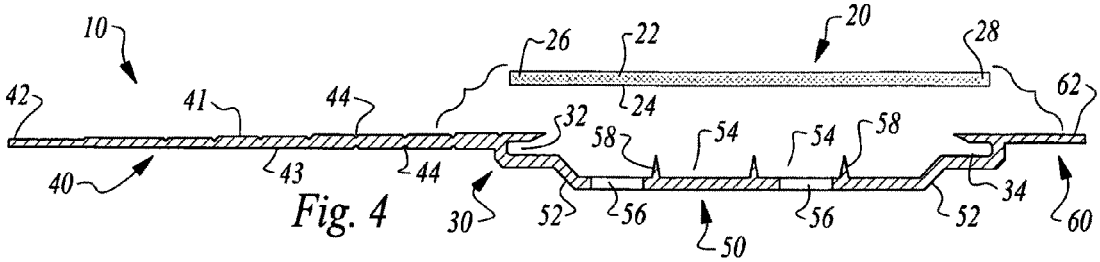
FIG. 4 is an exploded view similar to that which is shown in FIG. 3, but with a corrugated mesh screen portion exploded away from a support portion of the assembly.

In essence, and with particular reference to FIGS. 2-4, basic details of the debris preclusion assembly 10 are described, according to the most preferred embodiment. The assembly 10 is comprised of two main parts including a corrugated mesh 20 screen and an underlying support 30. The screen 20 is fenestrated with sufficiently fine openings that debris is substantially entirely precluded from passing through the mesh 20. However, water is allowed to pass through the openings in the mesh 20.

Figure 14:
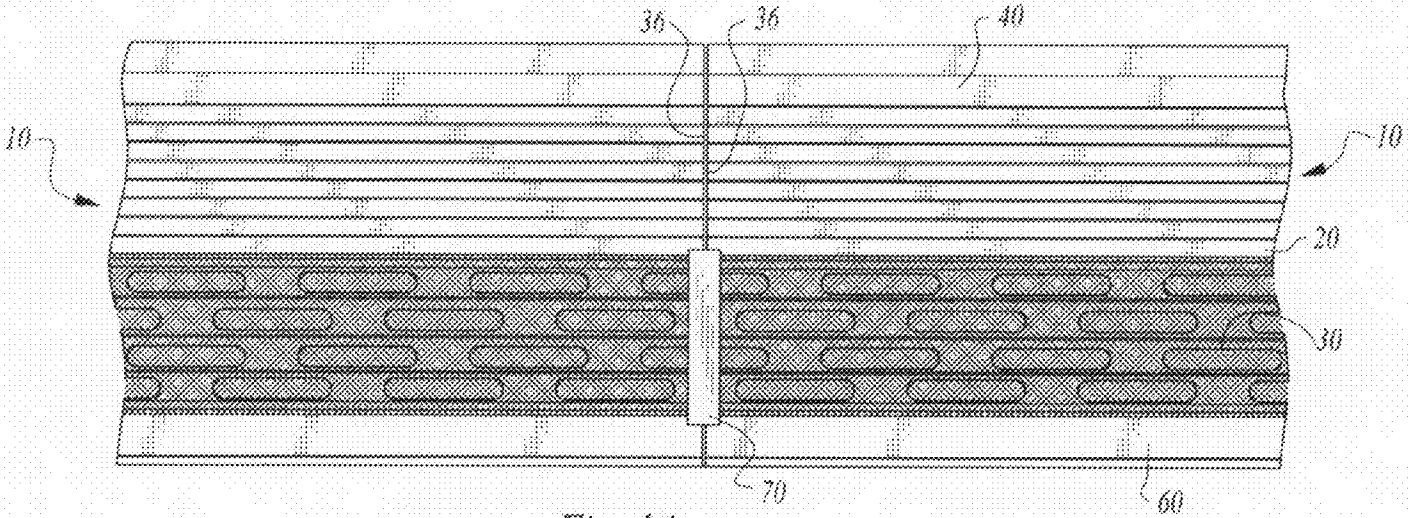
FIG. 14 is a top plan view of a pair of debris preclusion assemblies adjacent each other and with a coupler for joining ends of adjacent debris preclusion assemblies shown coupling the adjacent debris preclusion assemblies together.

The underlying support 30 is a rigid generally planar structure with a tab 40 portion extending up from a floor 50 portion, and with a front edge 60 portion most distant from the tab 40. The tab 40 is configured to rest upon the roof R, and preferably below the shingles S. The tab thus has water coming off of the roof R above the tab 40 and then flow over the corrugated mesh 20 and through the floor 50. The floor 50 underlies the corrugated mesh 20 and includes holes 56 therein which route the water down through the entire assembly 10 before falling into the gutter G. The front edge 60 provides a portion of the support 30 which can rest upon the lip L on the front of the gutter G. A coupler finger 70 (FIG. 14) is also provided which can secure adjacent lateral ends 36 of separate assemblies 10 together at joints so that sections of the assembly 10 shorter than the entire length of the gutter G can still entirely cover the gutter G.

More specifically, and with particular reference to FIGS. 1 and 5-12, details of the corrugated mesh 20 providing a preferred form of screen for the assembly 10, are described according to a most preferred embodiment. The corrugated mesh 20 is most preferably in the form of woven screen material typically of a weave including a plurality of strands extending in a first direction and a plurality of strands extending in a second direction perpendicular to the first direction and woven relative to the plurality of first strands. These strands are most preferably formed of stainless steel to provide a substantially non-corroding overall mesh 20 which also has sufficient strength characteristics to support the load associated with water, debris, snow, ice and other loads experienced by the mesh 20 when in the environment resting upon the gutter G. Other materials that could be provided as an alternative to stainless steel, or in some combination therewith could include various forms of plastic materials or other metals. Other forms of weaves could also be provided. It is also conceivable that rather than a woven mesh 20, that some other form of screen could be utilized, such as a perforated thin plate, while still providing at least some of the benefits according to this invention.

Beneficially, the overall mesh 20 is not entirely planar, but rather is bent into an undulating corrugated contour. These undulations are generally defined as alternating crests 22 and troughs 24. Each crest 22 and trough 24 extends from an upper edge 26 of the mesh 20 to a lower edge 28 of the mesh 20. Preferably, the mesh 20 is continuous with a length similar to a length between lateral ends 36 of the overall support 30, so that a continuous section of mesh 20 entirely covers the floor 50 of the support 30 within the debris preclusion assembly 10. As an alternative, separate sections of mesh 20 could be provided upon each support 30. It is also conceivable that multiple sections of support 30 could be overlaid by a single longer section of corrugated mesh 20 or other screen material.

Most preferably, the crests 20 and troughs 24 are substantially perpendicular to the longest dimension of the mesh 20 and support 30 extending between the lateral ends 36 of the support 30. Thus, the crests 22 and troughs 24 generally extend with upper edges 26 thereof at a higher side of the corrugated mesh 20 and with lower edges 28 of the crests 22 and troughs 24 adjacent a lower side of the corrugated mesh 20, when the entire assembly 10 is placed upon a gutter G adjacent a facia F in an eave location of the roof R (FIG. 1).

With such an undulating configuration, the corrugated mesh 20 or other screen material beneficially channels water falling off of the roof R into concentrated flows within the troughs 24. Concentration of the water as it strikes the corrugated mesh 20 provides a number of benefits. Water has a tendency to adhere to the corrugated mesh 20 rather than pass through the corrugated mesh 20. Such adherence can be detrimental in that it can allow the water to skip along the corrugated mesh 20 entirely to the lip L at the front of the gutter G and then fall over a front edge of the gutter G. One force which tends to resist such adherence of the water to the corrugated mesh 20 is the weight of the water itself. By concentrating the water flowing down off of the shingles S of the roof R into channels between the crests 20 and within the troughs 24 this weight of the water is concentrated. The concentrated water is then more likely to release from the corrugated mesh 20 and fall down into the gutter G.

The debris preclusion assembly 10 with such a corrugated mesh 20 can thus perform exceptionally well even when challenging circumstances are encountered. One challenging circumstance is the scenario where a downpour of rain is encountered. During such a heavy downpour, a gutter guard that is designed to perform adequately ninety percent of the time can fail to a large degree. Large amounts of water cascading off of the roof R can pass entirely over the gutter G and then cause damage to adjacent landscaping and generally thwart the entire purpose of providing the gutters G in the first place.

With corrugation of the mesh 20, such downpours can be more adequately accommodated. The large volumes of water are concentrated within the troughs 24 and the weight of this water flow in high volumes works complementally with the troughs 20 to increase the rate at which the water separates from the mesh 20 and falls into the gutter G. With the gutter G also having been precluded from debris by use of the assembly 10, the gutter G is entirely open and available to handle this large volume of water during such a downpour. Such large volumes of water can have a tendency to cause planar mesh to deflect. By corrugating the mesh 20 and providing a support 30 beneath the corrugated mesh 20, any such deflection of the corrugated mesh 20 is resisted.

In another challenging scenario, a roof with a rather steep pitch is encountered which causes the entire assembly 10 to be installed at a rather steep angle between an upper edge 26 of the mesh 20 and the lower edge 28 of the mesh 20. As this angle becomes steeper and steeper, the forces of gravity are not acting perpendicular to the mesh 20, but rather are to some extent acting along the general plane in which the mesh 20 is oriented. Gravity forces associated with the weight of the water are thus diminished and the tendency of the water to adhere to the mesh 20 is increased.

By channeling the water into troughs 24, this tendency of the water to adhere in greater amounts to the mesh 20 when greatly sloped can still most effectively be overcome. Furthermore, when the troughs 24 reach the front edge 60 of the overall debris preclusion assembly 10, large volumes of this water are adhering to an underside of troughs 24 and abut the front edge 60 with substantially all of the water then being directed downward into the gutter G. Thus, corrugation of the mesh 20 or other screen beneficially enhances the effectiveness of the entire assembly 10 in conducting water down into the gutter G while still precluding the passage of debris into the gutter G. The efficiency with which water is pulled through the mesh 20 and into the gutter G facilitates to some extent the ability of the overall assembly 10 to be configured with a lesser width of mesh 20 between the upper edge 26 and lower edge 28 and still function adequately. An overall assembly 10 of simpler construction can thus be accommodated and still maintain high performance attributes.

With particular reference to FIGS. 1-4 and 13, details of the support 30 are described, according to a most preferred embodiment. The support 30 provides an underlying substantially rigid structure to support the mesh 20 in position over the gutter G and to cover portions of the gutter G which are not directly covered by the mesh 20. Furthermore, the support 30 interfaces with the roof R above structural portions of the roof R such as plywood P or other sheeting beneath a moisture barrier M and beneath shingles S, so that water is effectively routed onto the debris preclusion assembly 10 without interfering with the construction of the roof R.

The support 30 is preferably elongate in form and has a substantially constant cross-sectional form (other than positioning of the holes 56) to make the entire support 30 suitable for forming by extrusion. Other fabrication techniques can also be provided for the support 30, including injection molding, machining, casting, press forming or assembly from separate subparts welded, bonded or otherwise fastened together.

Most preferably, the support 30 is formed of a metal which is compatible with the gutter G environment with a minimum of detrimental corrosion. Aluminum is most preferred due to its low corrosion and lightweight characteristics, as well as suitable strength when proper alloys of aluminum are selected and thicknesses of the various portions of the support 30 are appropriately sized to accommodate the strength characteristics of aluminum. However, other materials could also be utilized for forming the support 30 including stainless steel, titanium, other metals, as well as various plastic materials.

For the support 30 to adequately hold the mesh 20 in position over the gutter G, the support 30 preferably includes an upper slot 32 facing a lower slot 34 bordering the floor 50. The upper slot 32 has an upper portion which acts as an extension of the tab 40. This extension associated with the upper slot 32 is important in that water falling off of the shingles S on the roof R are first generally routed onto portions of the tab 10 and then fall over the extension forming the upper portion of the upper slot 32, before being routed onto the mesh 20 over the floor 50. This extension keeps debris from finding its way under the mesh 20.

When the mesh 20 is provided with a corrugated form, these slots 32, 34 are sized to accommodate this undulating structure. Such accommodation can be in the form of increasing the thickness of the slots 32, 34 to have a greater width than a mere thickness of the screen 20, but rather to accommodate an amplitude between the troughs 24 and crests 22. As an alternative, the corrugated mesh 20 can be collapsed somewhat adjacent the upper edge 26 and lower edge 28 so that the slots 32, 34 will have a width greater than a thickness of the mesh 20 but less than an amplitude between the crests 22 and troughs 24 of the mesh 20. The mesh 20 can be captured within the slots 32, 34 with fasteners, by crimping, by merely providing a friction fit, or by sizing a distance between the slots 32, 34 to be such that the mesh 20 can freely float within the slots 32, 34 but remain therein due to the size of the mesh 20 between the upper edge 26 and lower edge 28 being greater than a distance between the upper slot 32 and lower slot 34.

The support 30 includes lateral ends 36 (FIGS. 1 and 14) which define opposite ends between a length of the support 30 and the overall length of each section of the assembly 10. These lateral ends are preferably straight. A coupler finger 70 (FIG. 14) can be provided to secure these lateral ends 36 together. The coupler fingers 70 can have a variety of different configurations, such as configurations for such fingers disclosed in U.S. patent application Ser. No. 12/004,141, published as U.S. Patent Application Publication No. 2008/0163561, incorporated herein by reference in its entirety.

As an alternative to the fingers 70, separate assemblies 100 could merely be positioned with lateral ends 36 abutting each other. Optionally, the mesh 20 could be slightly longer than the underlying support 30 with excess length of the mesh 20 extending slightly past the lateral ends 36 and then bent down. When the separate assemblies 10 are placed adjacent each other, the meshes 20 of the separate assemblies 10 press together to filter debris while allowing water to fall between the adjacent assemblies 10.

At inside or outside corners, on the overall roof R, these lateral ends 36 can be cut to keep ends 36 of adjacent assemblies 10 adjacent each other around such corners and still allow the coupler fingers 70 to secure the two sections together. The coupler fingers 70 also act to some degree to preclude debris from getting around the assembly 10 at these joints where the lateral ends 36 of separate assemblies 10 come together.

With continuing reference to FIGS. 1-4 and 13, details of the tab 40 defining an upper portion of the support 30, are described according to this most preferred embodiment. The tab 40 is preferably provided on an upper portion of the support 30 to cause a portion of the support 30 to extend upward and substantially within a plane of the overall support 30 for placement between the shingles S and other portions of the roof R beneath the shingles S. The tab 40 ensures that water and debris falling off of the roof R and traveling over the shingles S will remain on top of the tab 40 and over the support 30, rather than finding their way beneath the tab 40.

The tab 40 is preferably rigid and formed along with the support 30 from the same material forming the support 30. The tab 40 includes a top surface 41 opposite a bottom surface 43 which are generally parallel with each other. However, these surfaces 41, 43 preferably have a slight taper so that a tip 42 of the tab 40 most distant from the front edge 60 of the support 30 is slightly thinner than portions of the tab 40 adjacent the floor 50 of the support 30.

The tab 40 preferably includes a plurality of score lines 44 extending generally parallel with the tip 42 along a longest dimension of the tab 40. Some of the score lines are preferably provided in the bottom surface 43, with most of the score lines 44 located in the top surface 41. Those score lines 44 located in the bottom surface 43 are preferably aligned with score lines 44 in the top surface 41. The score lines 44 provide three purposes. First, they provide locations at which the tab 40 can be readily bent, such as to cause the tab 40 to bend to match a pitch of the roof R and then transition to a closer to horizontal direction of extension over the gutter G. Such a configuration can be required in situations where the roof R has a steep pitch and the shingles S extend too far down towards the gutter G.

Second, the score lines 44 provide a convenient location for trimming of the tab 40 should it be desired to have the tab 40 cut to a shorter length. Third, the score lines 44 generally increase a friction experienced between the tab 40 and shingles S and other portions of the roof R adjacent the tab 40, which can help to keep the support 30 precisely positioned where desired overlying the gutter G.

The tab 40 is substantially planar and aligned in a common plane with the extension on the upper surface of the upper slot 32. This plane also preferably continues with an upper portion of the lower slot 34 and in parallel with a plate 62 of the front edge 60, so that the entire support 30 has a generally planar form (before any bending of the tab 40). The floor 50 is provided in a lower plane parallel with the plane in which the tab 40 and front edge 60 are located.

With continuing reference to FIGS. 1-4 and 13, details of the floor 50 are described, according to this most preferred embodiment. The floor 50 resides slightly below the mesh 20 to provide a space in which water can travel after coming into contact with the mesh 20, and typically passing through the mesh 20 but still adhering for some time to an underside of the mesh 20. This floor 50 includes transitions 52 at upper and lower edges thereof which are preferably diagonal and position the floor 50 beneath the slots 32, 34 and beneath a plane in which the tab 40 and front edge 60 reside.

The floor 50 includes a plurality of channels 54 extending along a length of the support 30 between the lateral ends 36. These channels 54 are separated apart by ribs 58 which extend up from the floor 50, preferably perpendicular to the floor 50. Holes 56 are provided within each of the channels 54 and between the ribs 58. These holes 56 are preferably elongate in form and have a width less than a width of each channel and a length greater than a spacing between adjacent holes 56 within a common channel 54. Thus, over half of the floor 50 is defined by holes 56. The holes 56 in adjacent channels 54 are preferably offset from each other so that the strength of the floor 50 can be maximized even though a majority of the floor 50 is defined by the holes 56.

Most preferably, the holes 56 have a width between adjacent ribs 58 which is less than a distance between adjacent ribs 58. As best seen in FIGS. 3 and 4, the holes 56 are preferably closer to adjacent ribs 58 which are below each hole 56 than a distance from ribs 58 above each hole 56. By positioning the holes 56 closer to ribs 58 below each hole 56, any propensity for water to pool above each rib 58 is precluded.

The ribs 58 preferably taper to a point so that the ribs 58 have a greater thickness adjacent the floor 50 than at tips of the ribs 58. The tips of the ribs 58 define those portions of the support 30 which come into contact with the corrugated mesh 20, at troughs 24 on the corrugated mesh 20. These troughs 24 preferably extend perpendicular to the direction in which the ribs 58 extend, so that support of the troughs 24 of the corrugated mesh 20 by the ribs 58 occur at points. If desired, holes 56 in the floor 50 can be particularly positioned to be aligned with the points of contact between the ribs 58 in the troughs 24 in the mesh 20 so that holes 56 are readily available at the precise locations where water comes off of the mesh 20 when traveling through a trough 24 and then abutting one of the ribs 58 as the water clings to an underside of each trough 24 to some extent. However, such precise alignment of the holes 56 with the troughs 24 is not considered necessary for adequate performance of the overall assembly 10.

Figure 5:
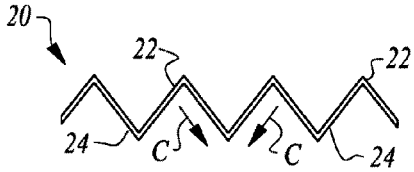
FIGS. 5-12 are front elevation views of various alternative configurations for the corrugated mesh screen of this invention.
Figure 6:
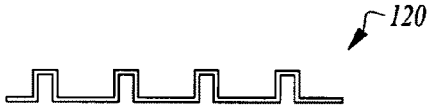

With particular reference to FIGS. 5-12, various different alternative embodiments for the mesh 20 are shown. FIG. 5 depicts a front elevation view of a corrugated mesh 20 having a zig-zag form. Arrows C depict how water coming off of shingles S on the roof R will tend to be channeled down into the trough 24 between each crest 22. In FIG. 6 an alternative mesh 120 is shown which is generally crenelated with relatively small merlons between relatively larger crenels.

Figure 9:
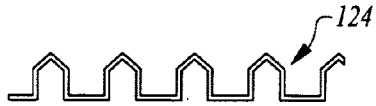
Figure 10:
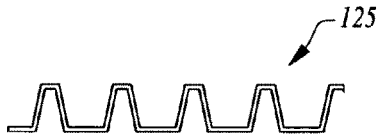
Figure 7:
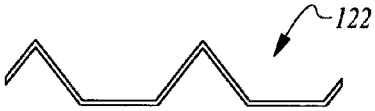
Figure 8:
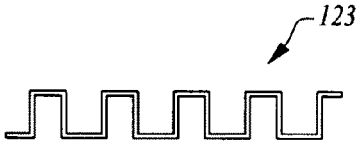

In FIG. 7 an alternative mesh 122 is depicted which has a zig-zag form with planar spacers therebetween. Such a configuration causes the troughs 24 to be rather large compared to the crests 22. FIG. 8 depicts an alternative mesh 123 which has a more symmetrical crenelated form. FIG. 9 depicts an alternative mesh 124 which is generally crenelated but with pointed peaks on each of the merlons. FIG. 10 depicts an alternative mesh 125 which has an undulating form which is generally in the form of truncated crests and troughs, and with the troughs larger than the crests.

Figure 11:
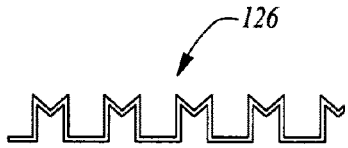
Figure 12:
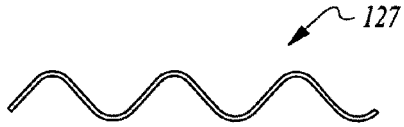
Figure 13:
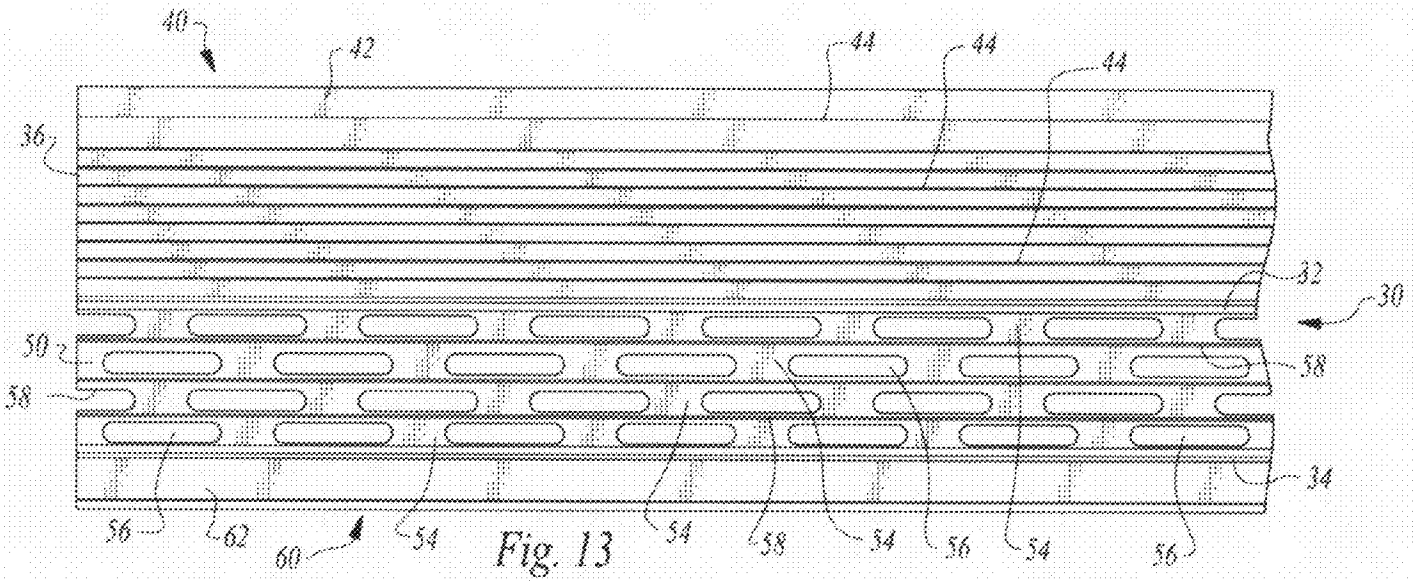
FIG. 13 is a top plan view of the support portion of the debris preclusion assembly of this invention.

FIG. 11 depicts a further alternative mesh 126 which has larger primary troughs and smaller secondary troughs and pairs of crests on either side of troughs. FIG. 12 depicts a further alternative mesh 127 which has a more simple symmetrical undulating form similar to that of a sine wave. Each of these alternative mesh configurations 120, 123, 124, 125, 126, 127 could be provided as depicted or inverted and provided in an inverted configuration. Furthermore, other alterations to these mesh configurations could be provided with different patterns, or by adjusting the amplitude or frequency of the pattern of the mesh 120.

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. A gutter debris preclusion system comprising:

a substantially rigid support having an elongate form between a pair of lateral ends opposite each other;

a screen having a fenestrated configuration to allow water to pass therethrough while precluding the passage of debris sized larger than fenestrations in the screen;

said screen coupled to said rigid support and positioned overlying said support;

said screen extending along a length of said rigid support between said pair of lateral ends, wherein said rigid support is wider than said screen in a direction perpendicular to a length of said rigid support between said lateral ends, said screen coupled to said rigid support with an upper portion of said rigid support on one side of said screen including an extension overlapping on an upper edge of said screen;

said screen in contact with said support at a plurality of locations beneath said screen;

said rigid support includes a floor on a portion of said rigid support located beneath said screen, said floor spaced from said screen, said floor including plurality of holes therein, said floor including ribs extending up from said floor, said ribs in contact with said screen;

said ribs, are elongate in form and being oriented substantially parallel with each other and extending between said lateral ends of said rigid support; and, said screen being bent into a configuration including multiple crests alternating with multiple troughs, with said troughs closer to said rigid support than said crests and with at least some of said troughs in contact with said rigid support, wherein said troughs extend substantially perpendicular to said ribs;

wherein said extension defines an upper portion of a slot, said upper edge of the said screen located within said slot and with both portions of said crests of said screen and portions of said troughs of said screen received within said slot.

2. The system of claim 1 wherein portions of said crests of said screen and portions of said troughs of said screen received within said slot.

3. The system of claim 1 wherein said upper portion of said rigid support is provided in the form of a tab extending from said extension adjacent said slot to a tip defining an uppermost edge of said tab.

4. The system of claim 3 wherein said tab tapers from a greater thickness adjacent said slot to a lesser thickness adjacent said tip defining said uppermost edge of said tab.

5. The system of claim 4 wherein said tab is formed of a material which is capable of bending without breaking along a bend line extending parallel with said slot, said tab bendable to accommodate roofs of different pitches.

6. The system of claim 5 wherein said tab includes score lines thereon, said tab configured to be frangible along said score lines to allow said tab to be custom trimmed to accommodate gutter and roof geometry adjacent said system.

7. The system of claim 1 wherein said floor of said rigid support including channels located between said ribs with said holes located within said channels.

8. The system of claim 7 wherein said holes have a width less than a distance between adjacent said ribs, and with said holes having a length greater than a width.

9. The system of claim 8 wherein said holes have a length longer than a space between adjacent holes within common said channels, such that a majority of a length of said channels is defined by said holes, rather than said space between said adjacent holes.

10. The system of claim 9 wherein said holes are located closer to an adjacent said rib located below said hole than a distance from an adjacent said rib above said hole.

11. The system of claim 10 wherein said ribs include tips opposite said floor which are oriented within a substantially common plane with said screen, said troughs of said screen in contact with said tips of said ribs, with said troughs extending substantially perpendicular to said ribs for substantially point contact between said troughs and said ribs at a plurality of separate points.

12. A gutter guard attachable overlying a gutter, comprising:

a screen; a substantially rigid support underlying said screen and in contact with an underside of said screen;

said rigid support including a plurality of holes therein;

said screen being bent into a configuration including multiple crests alternating with multiple troughs, with said, troughs closer to said rigid support than said crests and with at least some of said troughs in contact with said rigid support;

wherein said rigid support includes a pair of slots therein including an upper slot and a lower slot, said upper slot open in a direction facing an open side of said lower slot, said screen including an upper edge opposite a lower edge with said upper edge of said screen located within said upper slot of said rigid support and said lower edge of said screen located within said lower slot of said support, and with a size of said screen between said upper edge and said lower edge similar to a distance between said upper slot and said lower slot; and, wherein said rigid support includes a floor spaced below said screen, said floor including ribs extending up from said floor to tips in contact with said screen, said floor including said holes therein with said holes located between said ribs, said ribs extending non-parallel with said troughs.

13. The gutter guard of claim 12 wherein said slots each sized to receive both said troughs and said crests of said screen therein.

14. The gutter guard of claim 12 wherein an upper portion of said rigid support is provided in the form of a tab extending from said upper slot to a tip defining an uppermost edge of said tab.

15. The gutter guard of claim 14 wherein said tab tapers from a greater thickness adjacent said slot to a lesser thickness adjacent said tip defining said uppermost edge of said tab; wherein said tab is formed of a material which is capable of bending without breaking along a bend line extending parallel with said upper slot, said tab bendable to accommodate roofs of different pitches; and wherein said tab includes score lines thereon, said tab configured to be frangible along said score lines to allow said tab to be custom trimmed to accommodate gutter and roof geometry adjacent said system.

16. A method for keeping debris out of a gutter including the steps of:

selecting a length of elongate gutter guard including a screen, a substantially rigid support underlying the screen and in contact with an underside of the screen, the rigid support including a plurality of holes therein and the screen being bent into a configuration including multiple crests alternating with multiple troughs, with the troughs closer to the rigid support than the crests and with at least some of the troughs in contact with the rigid support, wherein said rigid support includes a pair of slots therein including an upper slot and a lower slot, said upper slot open in a direction facing an open side of said lower slot, said screen including an upper edge opposite a lower edge with said upper edge of said screen located within said upper slot of said rigid support and said lower edge of said screen located within said lower slot of said support, and with a size of said screen between said upper edge and said lower edge similar to a distance between said upper slot and said lower slot and wherein said rigid support includes a floor spaced below said screen, said floor including ribs extending up from said floor to tips in contact with said screen, said floor including said holes therein with said holes located between said ribs, said ribs extending non-parallel with said troughs;

placing the gutter guard over a gutter along a lower edge of a roof of a structure, with the front edge of the gutter guard adjacent and over a lip of the gutter and with the upper portion of the gutter guard opposite the front edge located over at least a portion of the roof adjacent the gutter;

allowing water and debris to travel down the roof, over the upper portion of the gutter guard and onto the screen; and filtering water and debris on the screen with water passing through the screen and debris prevented from passing through the screen.

17. The method of claim 16 including the further step of configuring the upper portion of the gutter guard as a tab extending above the screen; and customizing the tab by bending and/or cutting away portions of the tab to cause the tab to fit over at least portions of the roof and under shingles located upon the roof.

* * * * *